United States Patent [19]

Inagaki

[11] Patent Number: 4,622,749

[45] Date of Patent: Nov. 18, 1986

[54] ELECTRIC CAN OPENER

[75] Inventor: Kunitoshi Inagaki, Aichi, Japan

[73] Assignee: Kabushikikaisha Aichidenkikosakusho, Japan

[21] Appl. No.: 714,338

[22] Filed: Mar. 21, 1985

[30] Foreign Application Priority Data

May 7, 1984 [JP] Japan ..... 59-90326

[51] Int. Cl.[4] ..... B67B 7/46

[52] U.S. Cl. ..... 30/421; 30/DIG. 1

[58] Field of Search ..... 30/421, 423, 434, DIG. 1, 30/416, 424, 425, 426

[56] References Cited

U.S. PATENT DOCUMENTS

| | | | |
|---|---|---|---|
| D. 276,406 | 11/1984 | Johnson | 30/416 X |
| 2,883,745 | 4/1959 | Bristol | 30/424 X |
| 3,550,271 | 12/1970 | Meyer | 30/421 |
| 3,675,321 | 7/1972 | Arel | 30/421 |
| 3,925,887 | 12/1975 | McLean | 30/421 |
| 3,952,239 | 4/1976 | Owings | 30/DIG. 1 |
| 3,955,276 | 5/1976 | Pauty | 30/421 |
| 3,995,366 | 12/1976 | McLean | 30/421 |
| 4,084,123 | 4/1978 | Lineback | 30/DIG. 1 |

FOREIGN PATENT DOCUMENTS

| | | | |
|---|---|---|---|
| 2823373 | 4/1979 | Fed. Rep. of Germany | 30/423 |

*Primary Examiner*—Jimmy C. Peters

*Attorney, Agent, or Firm*—William A. Drucker

[57] ABSTRACT

An electric can opener operable in one hand of a user includes a body, a rotatable can driving wheel mounted on the front surface of the body, a cutter similarly mounted on the body, an electric motor accommodated inside the body to actuate the can driving wheel, a hollow cylindrical grip portion projecting from the body, and a power source unit contained in the grip portion to feed the electric motor.

3 Claims, 28 Drawing Figures

ELECTRIC CAN OPENER

BACKGROUND OF THE INVENTION

1. Field of the Invention

The present invention relates to an electric can opener for cutting open a can and more specifically to an electric can opener which can be operated in the hand of a user.

2. Description of the Prior Art

A can opener of this type consists of a body which is fitted with a cutter, a can driving wheel and an electric motor, and of a grip portion projecting forwardly from the body. When a can is cut open with such a can opener, it is supported with the grip portion grasped by the palm of one hand of the user and with both the can driving wheel and the cutter held on the can. In this case, however, the hand grasping the grip portion has to not only bear the weight of the can opener but also to prevent the heavy body situated before the grip portion from turning downwardly. Namely, a large downward force is exerted on the forefinger of the hand grasping the grip portion, while an equally large upward force is exerted on the palm near the base of the thumb of the hand. It thus involves great difficulty to hold stably the body of the can opener, and the can driving wheel and the cutter are hard to be operably held on the can.

SUMMARY OF THE INVENTION

This invention aims at providing an electric can opener wherein the above mentioned points are excluded.

Namely, an object of the present invention is to provide an electric can opener which a user can operate in his one hand when cutting open the lid of a can.

Another object of the present invention is to provide an electric can opener which is easily held with its thick grip portion grasped fitly by the paln of the user's hand.

Still another object of the present invention is to provide an electric can opener wherein a power source unit for feeding an electric motor can be accomodated in said thick grip portion.

If the grip portion can serve also as the casing of the power source unit, an isolate casing for the power source unit is unnecessary. The electric can opener can consequently be made small-sized and easily be handled.

Still another object of the present invention is to provide an electric can opener which, being held by the user's hand, is sufficiently balanced by positioning the power source unit inside the grip portion. Namely, since the power source unit is positioned inside the grip portion, the weight of the side of it opposite to the body is increased. A certain weight can thus be exerted on the little finger apart from the body as well as on the forefinger close to the body. As a consequence, the whole area of the palm can be applied on the outer surface of the grip portion, and the electric can opener can stably be held. In this manner, the can driving wheel can be held on the can more easily and exactly than in the case of a conventional can opener.

Other objects and advantages of the invention will become apparent during the following description taken in conjunction with the accompanying drawings.

BRIEF DESCRIPTION OF THE DRAWINGS

The drawings show the embodiments of the present invention in which.

DETAILED DESCRIPTION OF THE PREFERRED EMBODIMENT

Figure 7:
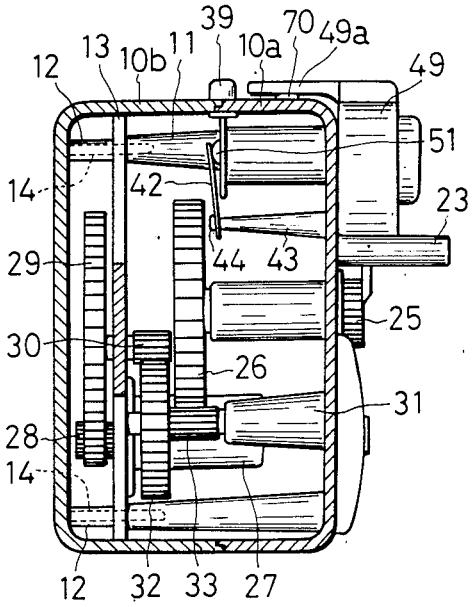
FIG. 7 is a section taken along a line VII—VII in FIG. 2.
Figure 8:
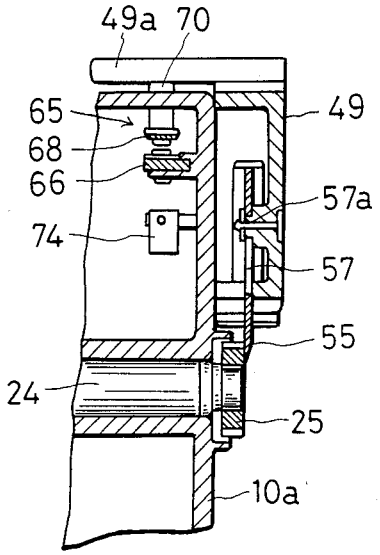
FIG. 8 is a fragmental section taken along a line VIII—VIII in FIG. 1.

Referring to drawings, the embodiments of the present invention are now explained. A housing 10 consists of a front element 10*a* and a rear element 10*b*, each being molded out of synthetic resins. These elements are jointed mutually by positioning a support pole 11 molded integrally with the front element 10*a* oppositely to a counter stud 12 via a support plate 13 and by screwing the front end of a fastening threaded bar 14, passed through the counter stud 12, into the support pole 11, as best seen in FIG. 7. The housing 10 is divided broadly into three parts, i.e., a body 15, a grip portion 16 and a joint portion 17.

The members provided in the body 15 are first explained. A drive shaft hole 20 and a mount hole 21 are formed in the front member 10*a*. Under the drive shaft hole 20 is protrudingly provided a can receiver 22, while under the mount hole 21 is projecting a can positioning piece 23. A can driving wheel 25 is secured on the front end of a drive shaft 24 inserted through said drive shaft hole 20, and a gear 26 is attached integrally on the rear end of said drive shaft 24. A pinion 28 is provided on the rotary shaft of an electric motor 27 mounted on the support plate 13. This pinion 28 cooperates with the aforementioned gear 26 via a couple of large and small gears 29 and 30 carried by the support plate 13 and via another couple of large and small gears 32 and 33 supported by the support plate 13 and by the large and small gears 29 and 30.

Figure 11:
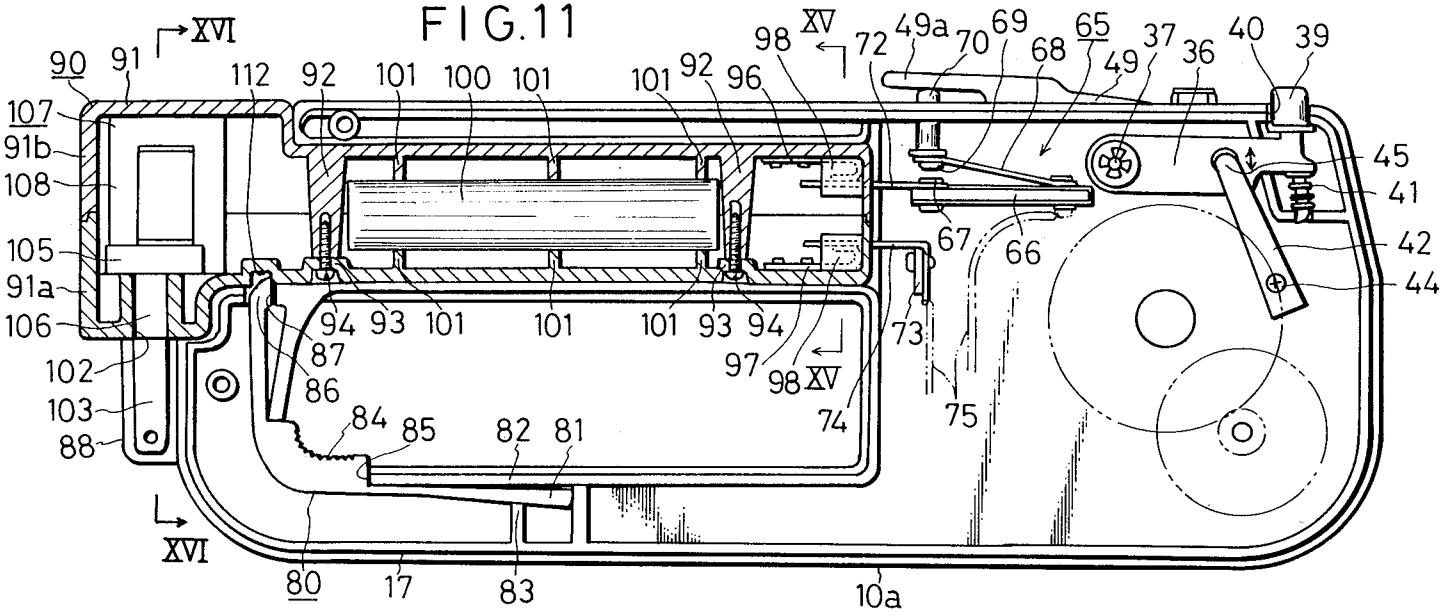
FIG. 11 is a view showing the electric can opener with one element of a housing thereof taken away and with a housing of the power source unit broken longitudinally.

Now inside the housing 10, a holder means 36 as shown in FIG. 11 is provided in the proximity of the mount hole 21. This holder means 36 is mounted, movably in indicated directions, on a pin 37 fixed against the housing. An opening 38 is formed in the intermediate portion of said holder means 36, while on the free end of the holder means 36 is provided a detach button 39 for the holder means, extending upwardly through an opening 40 bored through the housing. A biasing spring 41 is disposed between the free end of said holder means 36 and the housing. This spring 41 is adapted to bias said holder means 36 in such a direction and a manner as to locate the lower edge 38*a* of the opening 38 slightly under the axis of the mount hole 21. A push out piece 42 is provided in close proximity of the holder means 36. This push out piece 42 is made of a resilient sheet metal, and is fixed, at the base portion thereof, to a support 43 formed integrally with the front element 10*a* by means of a set screw 44. The free end portion 45 of the push out piece 42 is positioned so as to oppose the opening 38.

Figure 9:
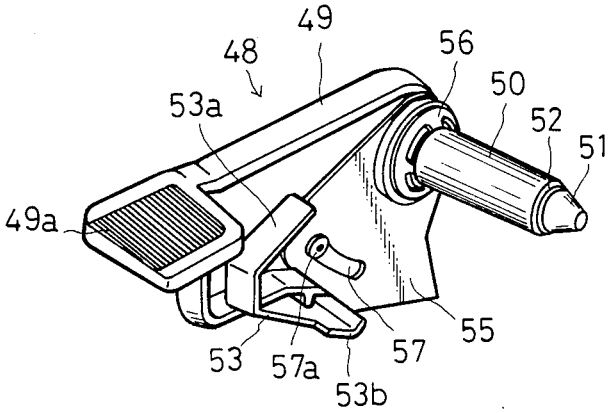
FIG. 9 is a perspective view of the can opener attachment.
Figure 10:
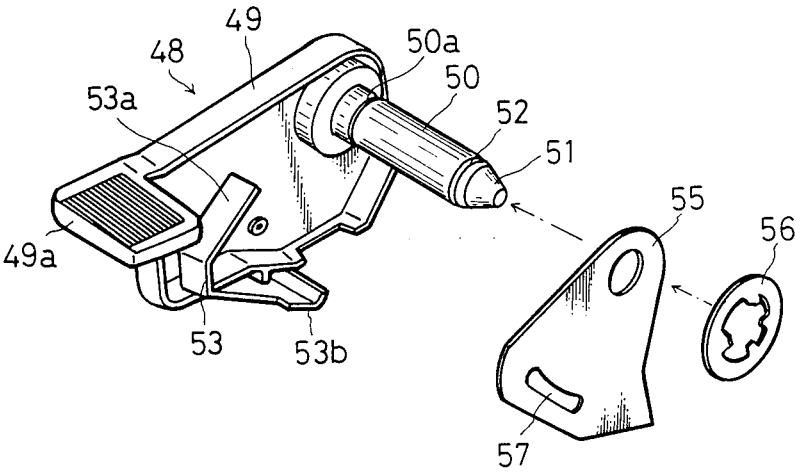
FIG. 10 is an exploded perspective view of the can opener attachment.

A can opener attachment 48 adapted to be mountable on and dismountable from the body 15 is now explained. First, this attachment 48 includes a base plate 49 made of synthetic resins as apparently shown in FIGS. 9 and 10. From a corner portion of the base plate 49 does project a metallic pivot shaft 50 with the head portion thereof embeded in said base plate 49. The free end 51 of the pivot shaft 50 is made tapered as is clearly shown in FIGS. 6, 9 and 10. The pivot shaft 50 is formed near the free end thereof with an annular engagement groove 52. An operation piece 49*a* is formed integrally with another corner of the base plate 49. On the rear surface of the base plate 49 is fixed the intermediate portion of a V-shaped leaf spring 53. The upper portion 53*a* of this leaf spring 53 is adapted to bias downwardly a cutter, as hereafter described, and the lower portion 53*b* is adapted to push down a seam 54*a* of a can 54. A cutter 55 is rotatably mounted on the base portion of the pivot shaft 50 and the drop out thereof is prevented by a stop ring 56 fitted in the groove 50*a* of the pivot shaft 50. A pin 57*a* fixed on the base plate 49 is inserted in an elongated arcuate hole 57. Said cutter 55 is downwardly biased by the upper portion 53*a* of the leaf spring 53 and the upper edge of the elongated hole 57 is in abutment with the pin 57*a*. On the upper portion of the base plate 49 is removably mounted a can holder 58 by means of a fastener 59. This can holder 58 is provided with an arm 60 with the base portion thereof secured on the base plate 49 by the fastener 59. The front end of the arm 60 is provided with a magnet 61 for attracting the can lid cut off.

A switch 65 accomodated in the body 15 includes a switch base 66 attached to the element 10*a*. A fixed contact 67 and the base portion of a resilient leaf contact 68 are secured on the switch base 66. The free end of the leaf contact 68 is provided with a movable contact adapted to contact with and to detach from the fixed contact 67. A push button 70 secured on the front end of the leaf contact 68 projects through an opening 71 formed in the element 10*a* to under the operation piece 49*a* of the can opener attachment 48. A connection terminal 72 secured to the fixed contact 67 extends towards a space 78, defined in the grip portion 16, for accomodating a battery case. Another connection terminal 74 extending into the space 78 is fixed on the terminal base 73 mounted on the element 10*a*. Lead wires 75 of the electric motor 27 are connected to this connection terminal 74 and to the base portion of the resilient leaf contact 68.

Next, a hold means 80 provided inside the joint portion 17 is made of synthetic resins and the base portion 81 thereof is interposed and secured between a side plate 82 of the element 10*a* and an opposing piece 83 confronting the side plate 82. The hold means 80 is provided with a push portion 84 projecting through an opening 85 and a hold piece 86 projecting through an opening 87.

A power source unit 90 is now explained. A housing 91 consists of two elements 91*a* and 91*b*. These elements are unified by setting legs 92 formed integrally with the element 91*b* on short counter studs 93 formed integrally with the element 91*a*, inserting long screws 94 from the side of the studs 93 and screwing it into the legs 92. The free ends of connection terminals 96 and 97 fixed to the elements 91*b* and 91*a* are disposed in rectangular openings 95 and 95 formed in the front end of the housing 91. The free ends of these connection terminals 96 and 97 are both U-shaped and the tips thereof are further enclosed by terminal boxes 98 provided integrally with the respective elements 91*b* and 91*a*. A battery or a group of cells 100 is provided in the middle of the space inside the housing 91 and is supported by battery supports 101 formed integrally with the element 91*a* or 91*b*. As the battery 100, a chargeable nickel-cadmium battery is used. Two blades 103 and 103 adapted to be inserted in a wall outlet project through an opening 102. The base portions 103*a* of these blades 103 are bent in the form of the letter L and are positioned fixedly against the housing 91 by adapting engage pieces 104 formed integrally with the element 91*a* of the housing into openings made in said base portions. Leg portions 106 of a spacer 105 made of insulating material are interposed between both the blades 103 and hold fixedly the same in position. A charging transformer 107 is set in position with the bottom portion of an iron core 108 thereof put in the spacer 105. The iron core 108 of the transformer 107, in the shown situation, is urged by the element 91*b* of the housing. Primary lead wires 109 are connected to the base portions 103*a* of the blades 103. The secondary lead wires of the transformer 107 are connected across the terminals of the battery 100 through a rectifier 160 and a charging resistor 111.

The power source unit 90 constructed as described above is inserted in the space 78 defined inside the grip portion 16, and front connection terminals 96 and 97 are connected to the connection terminals 72 and 74 respectively. In this case, the connection terminals 72 and 74 introduced through the opening 95 into the terminal boxes 98 and 98 are closely put between the front ends of the connection terminal 96 and 97 and the side walls 98*a* of the terminal boxes 98, and consequently the electrical connections between the connection terminals 96 and 72 and between the connection terminals 97 and 74 can be maintained in good condition. In the shown situation, the hold piece 86 in the hold means 80 is adapted in an engage recess 112 formed on the housing 91, and the power source unit 90 is thus prevented from dropping out from the space 78. In the above situation, protection plates 88 formed integrally with the housing 10 are disposed at both sides of the blades 103 and protect them against damage.

Figure 1:
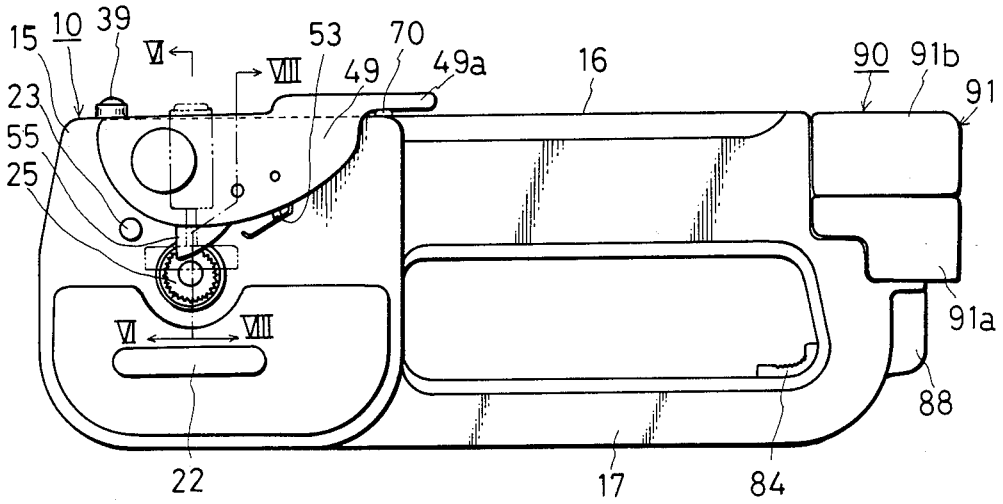
FIG. 1 is a front elevational view of an electric can opener.
Figure 2:
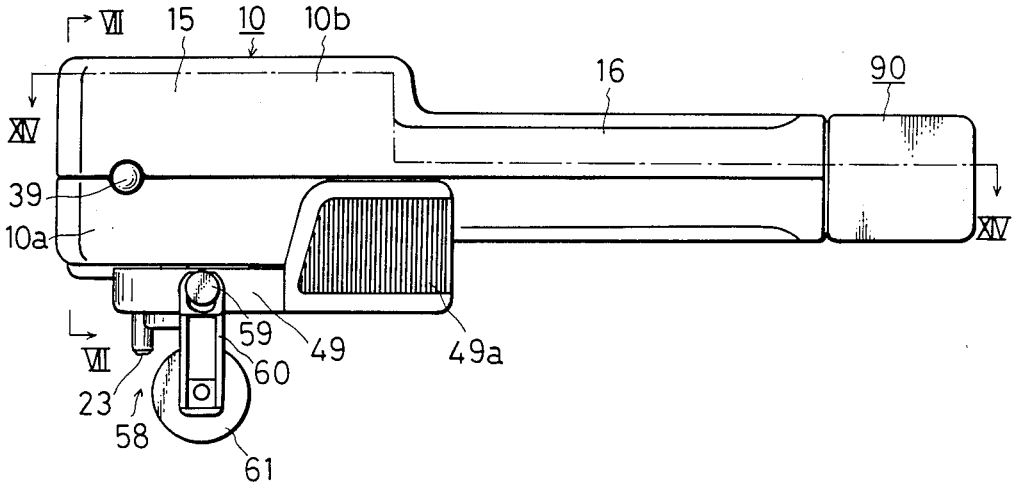
FIG. 2 is a plane view of the electric can opener.
Figure 3:
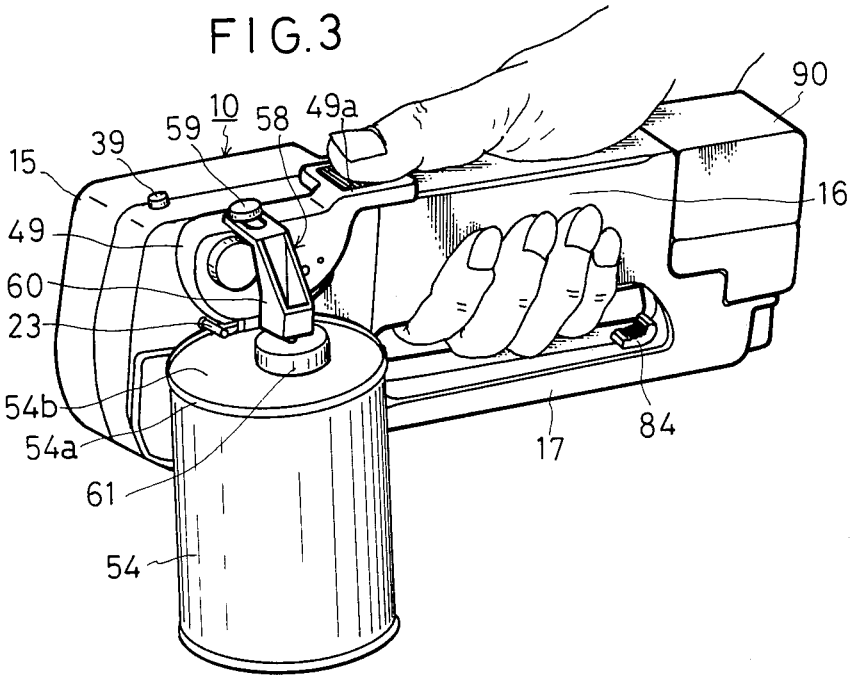
FIG. 3 is a perspective view showing the electric can opener in use.
Figure 4:
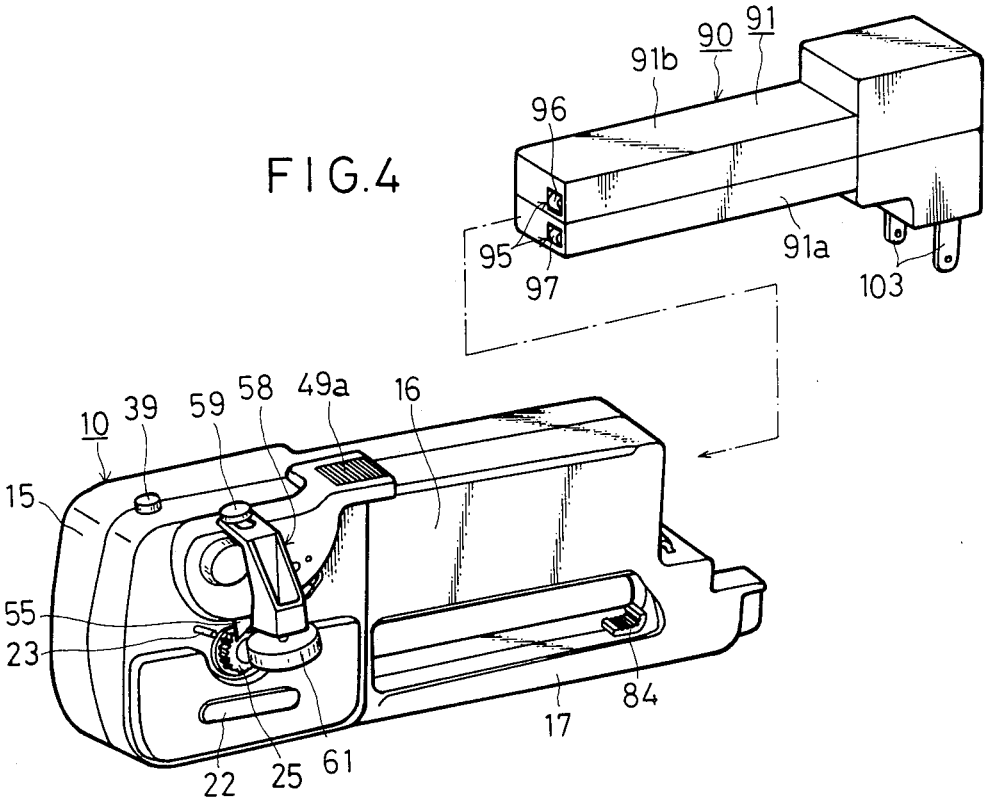
FIG. 4 is a perspective view showing the electric can opener and a power source unit taken out of it.
Figure 5:
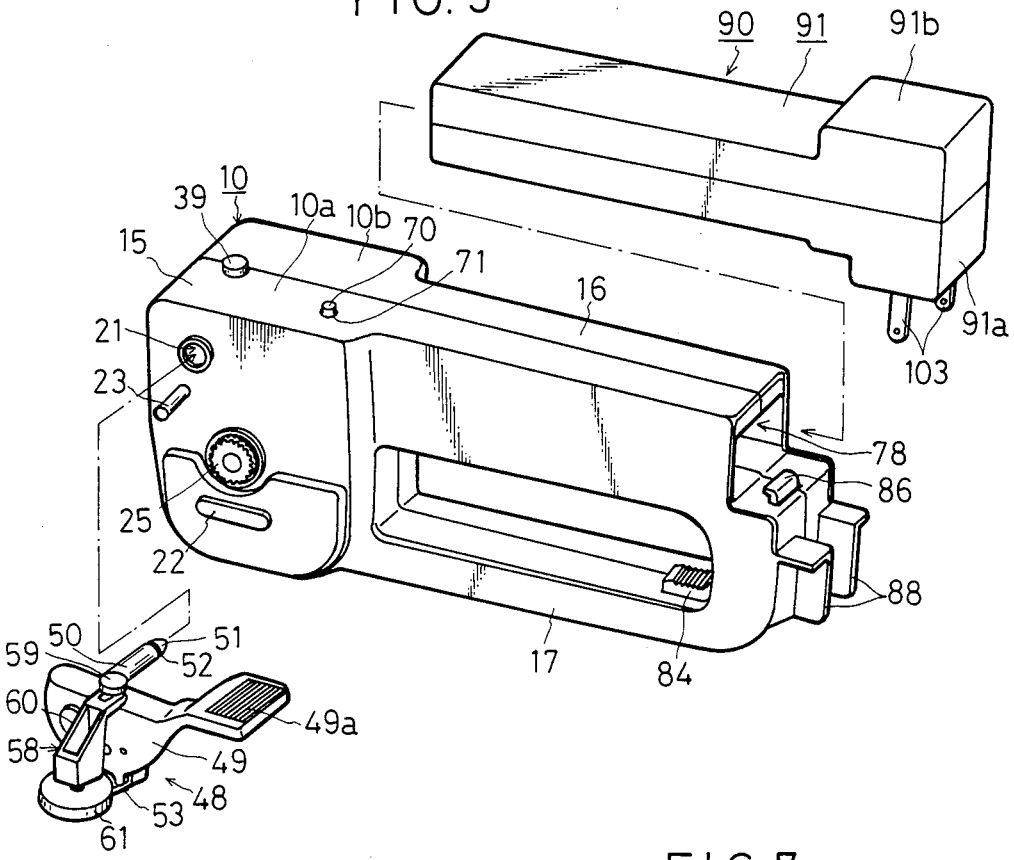
FIG. 5 is a perspective view showing the electric can opener, the power source unit taken out of it and a can opener attachment dismounted from the can opener.

The electric can opener constructed as described above is used in the situation as shown in FIG. 3. Namely, the grip portion 16 is grasped by one hand of the user and the operation piece 49*a* is operated by the thumb of the hand.

Figure 19:
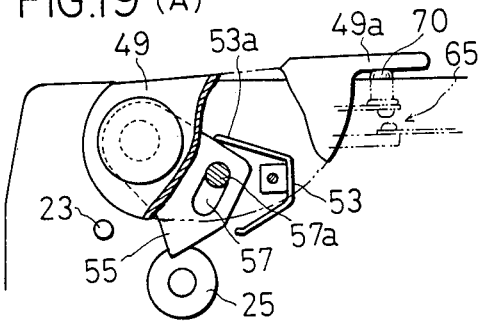
FIG. 19 is a view showing a process to cut open a can lid.
Figure 19:
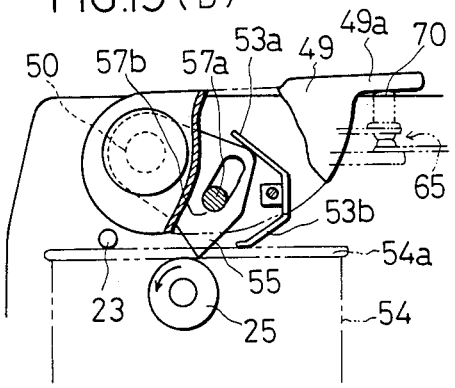
Figure 19:
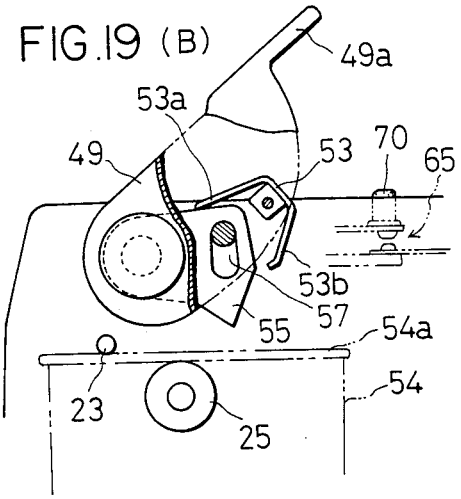
Figure 19:
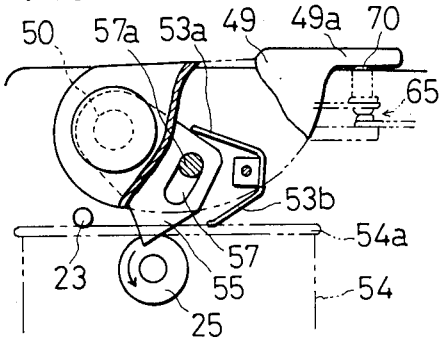
Figure 19:
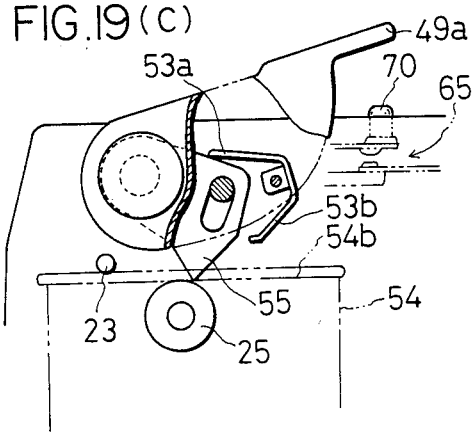
Figure 19:
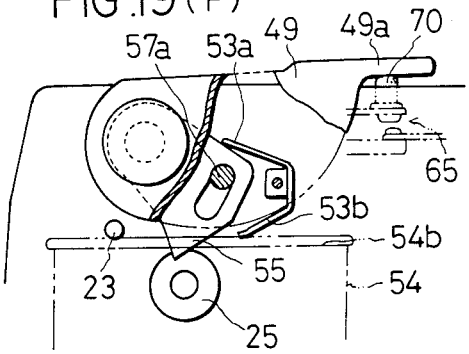
Figure 20:
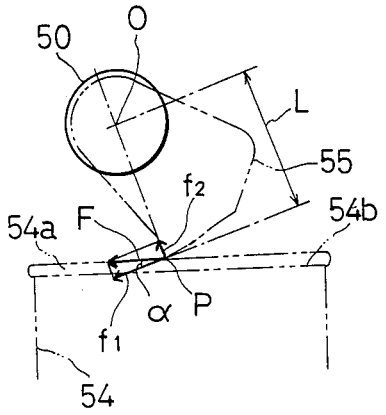
FIG. 20 is a view showing the relationship among the components of the force exerted on a cutter.

In the next, in cutting open the can, the operation piece 49*a* is turned up from the position shown in FIG. 19(A) to that in FIG. 19(B) and the cutter 55 is upwardly brought over the top of the can driving wheel 25. In this situation, the can driving wheel 25 is put under the seam 54*a* of the can 54 held by the other hand of the user, and the can positioning piece 23 is simultaneously abutted on the upper edge of the seam 54*a*. The operation piece 49*a* is then released to the lower position and the tip of the cutter 55 is brought into contact with the can lid 54*b* closely inside the seam 54*a*. In this situation, the seam 54*a* of the can 54 is still held on the can driving 25 even if though the user detaches his hand from the can 54. Next, the operation piece 49*a* is pushed down as shown in FIG. 19(D) and the lower portion 53*b* of the leaf spring 53 is abutted on the seam 54*a*, urging the seam 54*a* against the can driving wheel 25. As the operation piece 49*a* is further lowered down, the operation piece 49*a* pushes down the push button 70 and the power source switch 65 is closed. As the result of this operation, the battery 100 feeds the electric motor 27, which then rotates. The torque of the electric motor 27 is transmitted through gears to the can driving wheel 25, which is rotated in the direction shown by the arrow and rotates the can 54. As the operation piece 49*a* is lowered down, the cutter 55 is pressed against the can lid 54*b* by the upper portion 53*a* of the leaf spring 53 and the cutter 55 is forced on the can lid 54*b* by the abutment of the pin 57*a* against the lower edge of the elongated hole 57. The cutter 55 is then exerted on by a friction force which is directed to the left in FIG. 19(D) as the result of the friction between the cutter 55 and the can lid 54*b*. This force results in a clockwise torque around the pivot shaft 50 and, on account of this torque, the cutter 55 cuts into the can lid 54*b*, thus beginning to cut open the can 54. In FIG. 20 showing the relationship between the force and the torque, a drag force F due to the rotation of the can 54 is exerted on the point P, the point of contact between the cutter 55 and the can lid 54*a*, around the axis O of the pivot shaft 50. Since, however, the point O is situated over the point P with a certain angle between the can lid 54*a* and the line OP and is advanced than the point P in the turning direction of the can 54, the drag force F can be decomposed into a component $f_2$ along the line PO and another component $F_1$ exerted downwardly and parpendicularly to the line PO. With the angle $\alpha$ between the component $f_1$ and the drag force F, the component $f_1$ can be written as $f_1 = F \cdot \cos \alpha$. Since the angle $\alpha$, however, is set so as to give a condition $f_1 > f_2$, the clockwise torque around 0 becomes $L \cdot F \cdot \cos \alpha$ where L is the distance between the points 0 and P. Since the cutter 55 cuts deeply into can lid 54*b* under the torque due to the turning of the can 54, it is unnecessary, at the start of cutting of the cutter 54 into the can lid 54*b*, to push down the operation piece 49*a* strongly. Next, while cutting open the can, the cutter 55 is continuously subject to said torque and gives continuously the clockwise torque around the pivot shaft 50 as shown in FIG. 19(D) through the pin 57*a* to the base plate 49. The operation piece 49*a* thus continues to press the push button 70 and the power switch 65 is kept closed, the can lid being continuously cut open, even though the user detaches his hand from the operation piece 49*a*. Then, after the completion of the cutting open of the can, the torque applied on the cutter as the result of the turning of the can lid 54*b* dissapears, and consequently the torque applied on the plate 49 dissapears too. Accordingly, the base plate 49 is slightly returned in the counterclockwise direction by the reaction force against the force with which the lower portion 53*b* of the leaf spring 53 pushes downwards the seam 54*a*. The operation piece 49*a* thereby moves upwards to cease to urge downwardly the push button 70, opens the power switch 65 and stops the power feed to the electric motor 27, stopping the turning of the can 54. In this situation, since the seam 54*a* of the can 54 rests on the can driving wheel 25 and the cutter 55 is positioned inside this seam 54*a*, the can does not fall off by any means. Next, when the can 54 is to be detached, it is held by the hand of the user and the operation piece 49*a* is then pushed up to raise the cutter 55 higher than the upper edge of the seam 54*a* of the can 54 as shown in FIG. 19(B), the can being detached in this situation.

Figure 6:
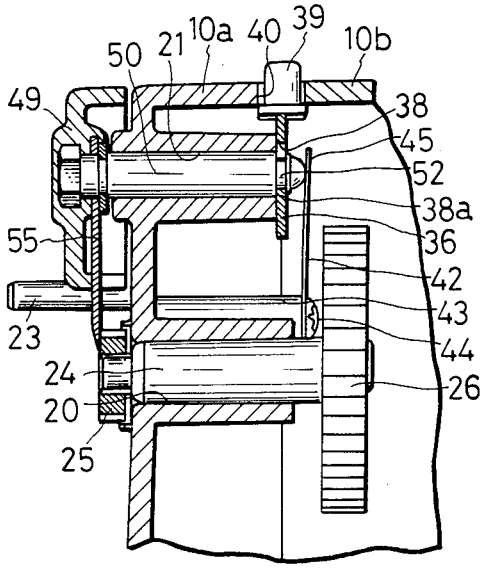
FIG. 6 is a fragmental section taken along a line VI—VI in FIG. 1.

The pushbutton 39 is now pushed in for the purpose of dismounting the can opener attachment 48 from the body 15. The holder means 36 is then moved downwardly and the periphery 38*a* of the opening 38 is made to disengage with the engagement groove 52 on the pivot shaft 50. The pivot shaft 50 is forwardly pushed out by the front end 45 of the push out piece 42 which is always under a biasing force. The attachment 48 can thereafter be detached from the body by pulling manually the pivot shaft 50 out of the mount hole 21. The can opener attachment 48 detached in this manner can easily be washed. When the washed attachment 48 is remounted on the body 15, the pivot shaft 50 is pushed into the mount hole 21. In this case, since the free end 51 of the pivot shaft 50 is made tapered as shown, the lower edge 38*a* of the opening 38 in the holder means 36 is urged downwardly as seen in FIG. 6 by the tapered free end surface 61 of the inserted pivot shaft. When the pivot shaft 50 is further pushed in until the engagement groove 52 opposes the lower edge 38*a*, the lower edge 38*a* comes into engagement with the engagement groove 52 by the biasing force of the spring 41 and such situation results that the pivot shaft 50 is prevented from dropping out from the mount hole 21.

Figure 13:
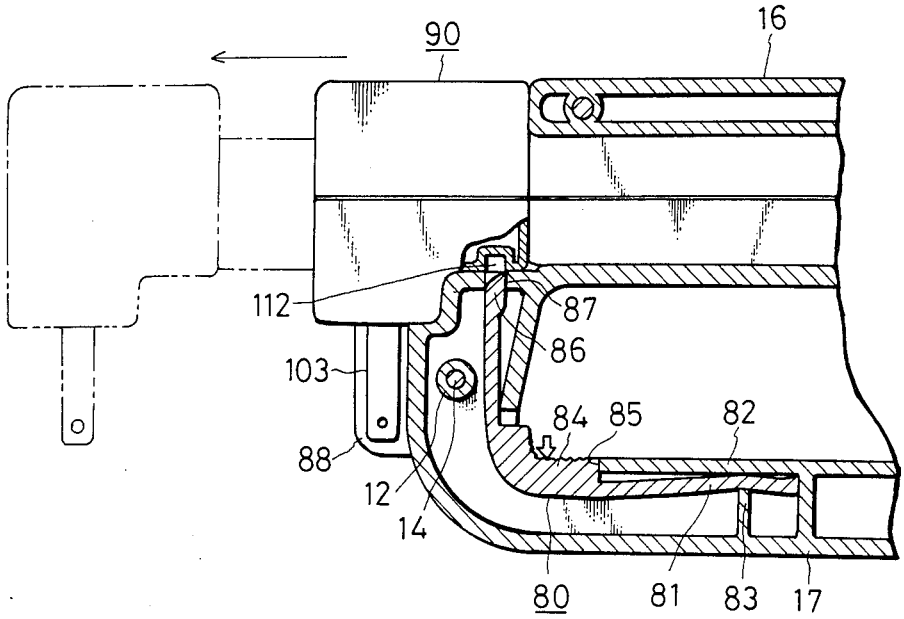
FIG. 13 is a fragmental sectional view showing the process to extract the power source unit.
Figure 14:
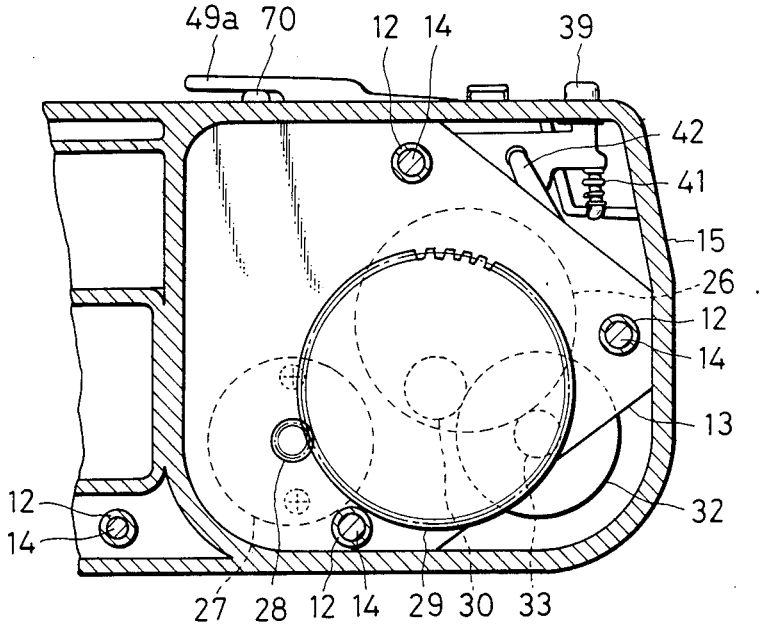
FIG. 14 is a fragmental section taken along a line XIV—XIV in FIG. 2.
Figure 16:
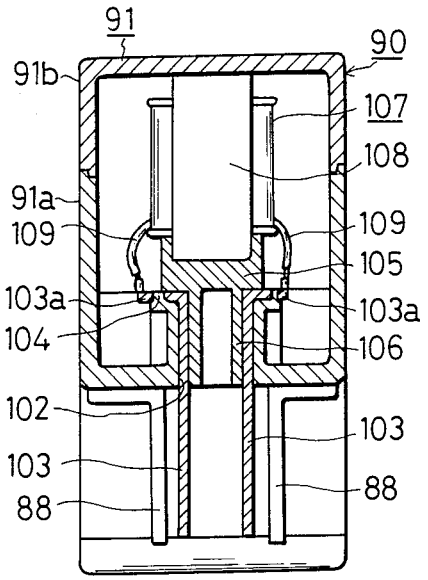
FIG. 16 is a section taken along a line XVI—XVI in FIG. 11.
Figure 15:
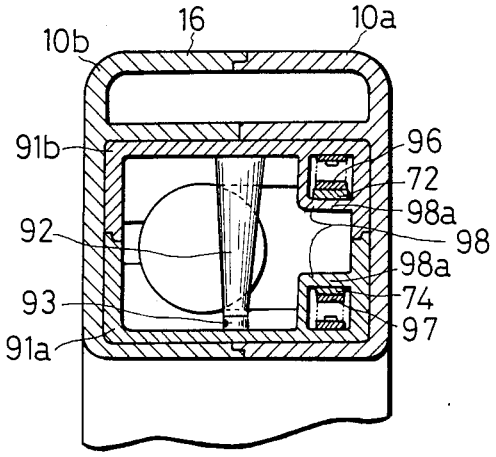
FIG. 15 is a section taken along a line XV—XV in FIG. 11.
Figure 17:
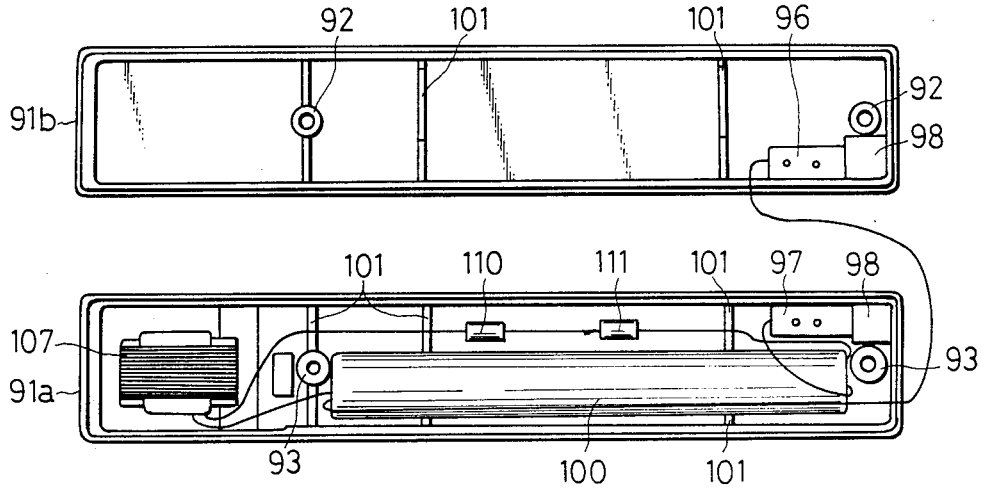
FIG. 17 is a view showing the housing of the power source unit with one element thereof dismounted.
Figure 18:
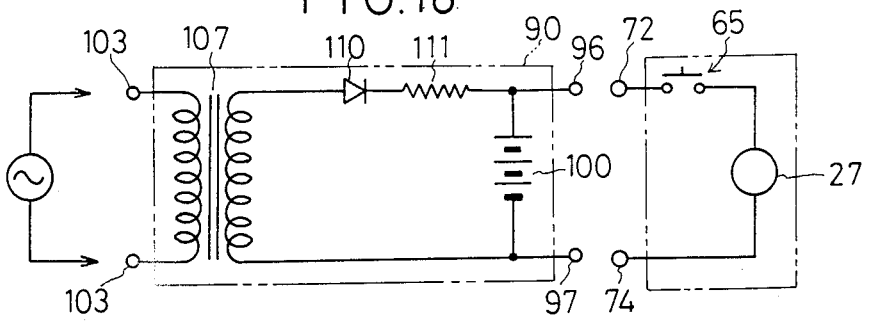
FIG. 18 is an electric circuit diagram.
Figure 21:
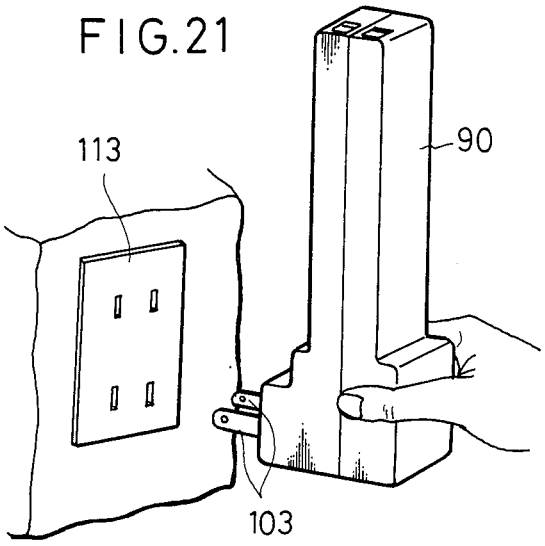
FIG. 21 is a perspective view showing an operation to insert the blade contacts of the power source unit into a domestic wall outlet.
Figure 22:
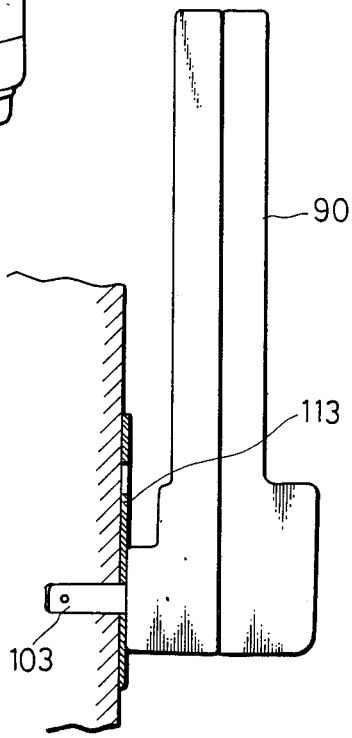
FIG. 22 is a view showing the power source unit being charged.

The battery 100 is charged when its discharge has considerably proceeded. The charging of the battery is done as follows. First the push portion 84 is moved so that it may retreat into the opening 85 as shown in FIG. 13. The hold means 80 bends due to its proper resiliency and the hold piece 86 disengages with the recessed portion 112, retreating into the opening 87. In this situation, the power source unit 90 is outwardly pulled from the space 78 in the grip portion 16. The blades 103 and 103 of the power source unit 90 are thereafter inserted into a domestic wall outlet 113 as shown in FIGS. 21 and 22. The AC voltage, which is applied across the blades 103 from the wall outlet in this situation, is stepped down by the transformer 107. The stepped-down low AC voltage is rectified by a rectifier 110, being transformed into a DC voltage. This DC voltage is supplied to the battery 100 through a resistor 111, and charges the battery 100.

Figure 12:
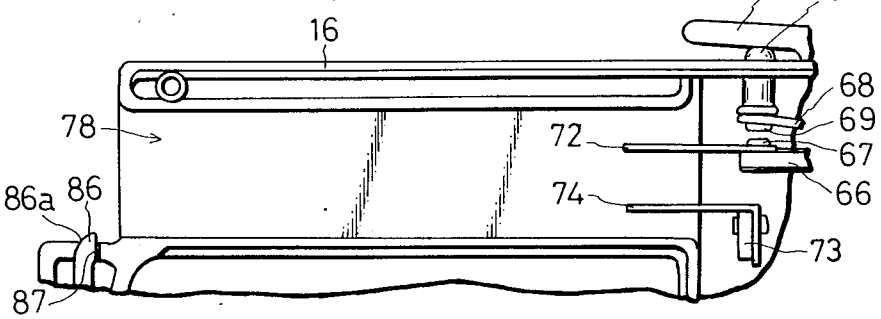
FIG. 12 is a partial view of the electric can opener with the electric power source unit extracted.

Next after the battery has completely been charged, the power source unit 90 is returned into the space 78 in the grip portion 16. In this case, since the front surface 86a of the hold piece 86 is tapered as shown, the hold piece 86 is smoothly brought into the opening 87 by making the front portion of the power source unit 90 advance from the left to the right as seen in FIG. 12. In this situation, the power source unit 90 is further thrusted into the space 78. When the connection terminals 96 and 97 have come into contact with the terminals 72 and 74 respectively, the hold piece 86 is restored to the position as shown in FIG. 11 by the resilient force of the hold means and projects through the opening 87 to engage with the recessed portion 112.

Figure 23:
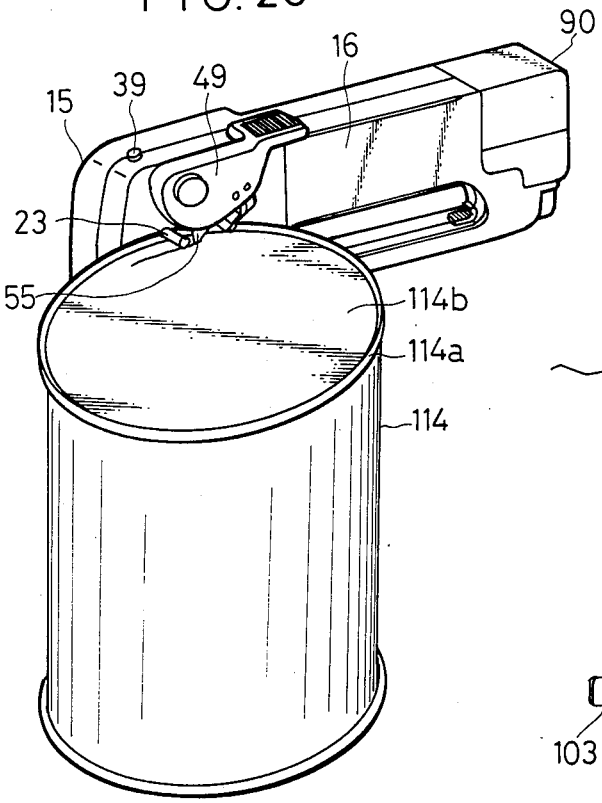
FIG. 23 is a perspective view showing a different method of using the electric can opener.

Next in FIG. 23 is shown a situation where a large can 114 is cut open with use of the above mentioned can opener. When such a large can 114 is cut open, it is placed, for example, on a table, and the can driving wheel 25 and the cutter 55 are applied to the seam 114*a* of the can 114 by the operation same as that mentioned above. After the cutter has been cut into the can lid 114*b* similarly as aforementioned, the electric can opener runs automatically around the periphery of the seam 114*a*, cutting open the can lid 114*b*.

What is claimed is:

1. In an electric can opener comprising a body, a can driving wheel mounted rotatably on the front surface of said body so as to be applied to the lower side of the seam of a can to be cut open, a cutter positioned rotatably against said front surface of said body so that the cutter cuts into the lid of said can, an electric motor accommodated inside said body and connected to said can driving wheel rotatably actuating the same, a hollow cylindrical grip portion projecting forwardly from said body, and a power source unit positioned in a space defined in said grip portion and connected to said electric motor for supplying electric power to the same, said grip portion being formed sufficiently thick to contain therein said power source unit, the improvement in which said power source unit comprises a housing, a chargeable battery contained in said housing, a pair of contact blades projecting from said housing for electrical connection with a domestic wall electric power outlet, a charging circuit including a transformer, a rectifier and a charging resistor, a pair of connection terminals provided inside said housing for electrical connection with said electrical motor, and a recessed portion formed on the outer surface of said housing, and said body is provided with a hold means for engagement with said recessed portion, said power source unit being adapted to be inserted into or extracted from said hollow cylindrical grip portion by operating said hold means.

2. An electric can opener comprising:

a body provided with a mounting hole and a front surface, a can driving wheel mounted rotatably on said front surface of said body to be applied to the lower side of the seam of a can lid to be cut open, a can opening attachment including a base plate, a pivot shaft secured to said base plate, a cutter mounted rotatably on said pivot shaft and a spring attached to said base plate biasing said cutter against said base plate, said can opener attachment detachably mounted on said front surface of said body with said pivot shaft inserted in said mounting hole so that said cutter cuts into the lid of a can, an electric motor inside said body connected to said can driving wheel rotatably actuating said wheel, a hollow grip portion projecting forwardly from said body, and a power source unit positioned in said grip portion and connected electrically to said motor supplying power to said motor.

3. An electric can opener as set forth in claim 2, wherein, said base plate is provided with means for turning said can opener attachment mounted on said body, and said body is provided with a push button operated by pushing down said turning means and said push button being electrically connected as a power switch for said electric motor.

* * * * *